US011050221B2

(12) United States Patent
Imai

(10) Patent No.: US 11,050,221 B2
(45) Date of Patent: Jun. 29, 2021

(54) SPARK PLUG WITH ANTI-LOOSENING FEATURE

(71) Applicant: NGK SPARK PLUG CO., LTD., Nagoya (JP)

(72) Inventor: Susumu Imai, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/835,393

(22) Filed: Mar. 31, 2020

(65) Prior Publication Data

US 2020/0313403 A1 Oct. 1, 2020

(30) Foreign Application Priority Data

Apr. 1, 2019 (JP) ..... JP2019-069848

(51) Int. Cl.
*H01T 13/08* (2006.01)

(52) U.S. Cl.
CPC ..... *H01T 13/08* (2013.01)

(58) Field of Classification Search
CPC ..... H01T 13/16; H01T 21/02; F02P 15/00
See application file for complete search history.

(56) References Cited

U.S. PATENT DOCUMENTS

| | | | | |
|---|---|---|---|---|
| 10,720,759 | B2 * | 7/2020 | Imai | H01T 13/36 |
| 10,790,639 | B1 * | 9/2020 | Imai | H01T 13/08 |
| 2020/0083674 | A1 * | 3/2020 | Imai | H01T 13/08 |

FOREIGN PATENT DOCUMENTS

| | | | |
|---|---|---|---|
| DE | 102013200977 | A1 * | 7/2014 |
| EP | 2950405 | A1 | 12/2015 |
| JP | UM-A-H02-007890 | | 1/1990 |
| JP | A-H09-063746 | | 3/1997 |
| JP | A-2006-236769 | | 9/2006 |
| JP | 2015-225774 | A | 12/2015 |

OTHER PUBLICATIONS

Office Action dated Mar. 2, 2021 from corresponding Japanese Patent Appl. No. 2019-069848.

* cited by examiner

*Primary Examiner* — Tracie Y Green
(74) *Attorney, Agent, or Firm* — Kusner & Jaffe

(57) ABSTRACT

A spark plug includes a tubular metallic shell having an attachment screw portion having an external thread, an insulator disposed inside the metallic shell and having an axial hole, and a center electrode disposed in the axial hole. The attachment screw portion has a pitch diameter local maximum portion at which the external thread has a locally maximum pitch diameter. The pitch diameter local maximum portion is located on the forward end side of a rear end of the center electrode in a direction along an axial line of the metallic shell.

5 Claims, 6 Drawing Sheets

SPARK PLUG WITH ANTI-LOOSENING FEATURE

CROSS-REFERENCE TO RELATED APPLICATION

This application claims priority from Japanese Patent Application No. 2019-069848 filed on Apr. 1, 2019, the entire contents of which are incorporated herein by reference.

TECHNICAL FIELD

The present invention relates to a spark plug.

BACKGROUND

A spark plug for ignition is attached to an internal combustion engine, such as a gasoline engine, by engaging a screw portion formed on the outer surface of a metallic shell of the spark plug with an internal thread provided in an engine head. In general, the screw portion has a uniform pitch diameter (see, for example, Japanese Patent Application Laid-Open (kokai) No. 2015-225774).

In general, as the length of the screw portion increases, the degree of freedom in determining the location of a water jacket of an engine advantageously increases. However, in the case where the pitch diameter of the screw portion is uniform, an increase in the length of the screw portion causes an increase in the area of contact between the screw portion and the engine head, and, as a result, the surface pressure per unit area decreases. Therefore, there has been a problem that the longer the screw portion, the more easily the spark plug loosens upon receipt of vibration generated in the combustion cycle of the engine.

The present invention has been accomplished in order to solve the above-mentioned problem, and can be realized as the following modes.

SUMMARY (1) According to one mode of the present invention, a spark plug is provided. The spark plug includes a tubular metallic shell having an attachment screw portion having an external thread, an insulator disposed inside the metallic shell and having an axial hole, and a center electrode disposed in the axial hole. The attachment screw portion has a pitch diameter local maximum portion at which the external thread has a locally maximum pitch diameter. The pitch diameter local maximum portion is located on a forward end side of a rear end of the center electrode in a direction along an axial line of the metallic shell. In the spark plug of this mode, upon contact with the engine head, the surface pressure increases at the pitch diameter local maximum portion. Therefore, wobbling of the spark plug can be prevented, whereby loosening of the spark plug can be prevented.

(2) In the spark plug of the above-described mode, the pitch diameter of the external thread may become the maximum at the pitch diameter local maximum portion. In the spark plug of this mode, since heat from the interior of an engine is efficiently released from the metallic shell through the pitch diameter local maximum portion, heat dissipation is enhanced.

(3) The spark plug of the above-described mode may be configured such that the insulator has an insulator step portion protruding outward, the metallic shell has a metallic shell internal step portion protruding inward, the insulator step portion is in contact with the metallic shell internal step portion via a packing, and the pitch diameter local maximum portion is located on a forward end side of a rear end of the metallic shell internal step portion in the direction along the axial line. In the spark plug of this mode, since heat from the interior of an engine is efficiently released from the metallic shell through the pitch diameter local maximum portion, heat dissipation is enhanced.

(4) In the spark plug of the above-described mode, the pitch diameter local maximum portion may be located at a position of the metallic shell internal step portion in the direction along the axial line. In the spark plug of this mode, since heat from the interior of an engine is efficiently released from the metallic shell through the pitch diameter local maximum portion, heat dissipation is enhanced.

(5) In the spark plug of the above-described mode, the attachment screw portion may have a length of 26.5 mm or more in the direction along the axial line. The spark plug of this mode can be preferably applied to a spark plug which has a long attachment screw portion and generally tends to loosen easily.

Notably, the present invention can be embodied in various forms. For example, the present invention can be embodied as an engine head or the like to which a spark plug is attached.

DETAILED DESCRIPTION OF PREFERRED EMBODIMENTS

A. First Embodiment

Figure 1:
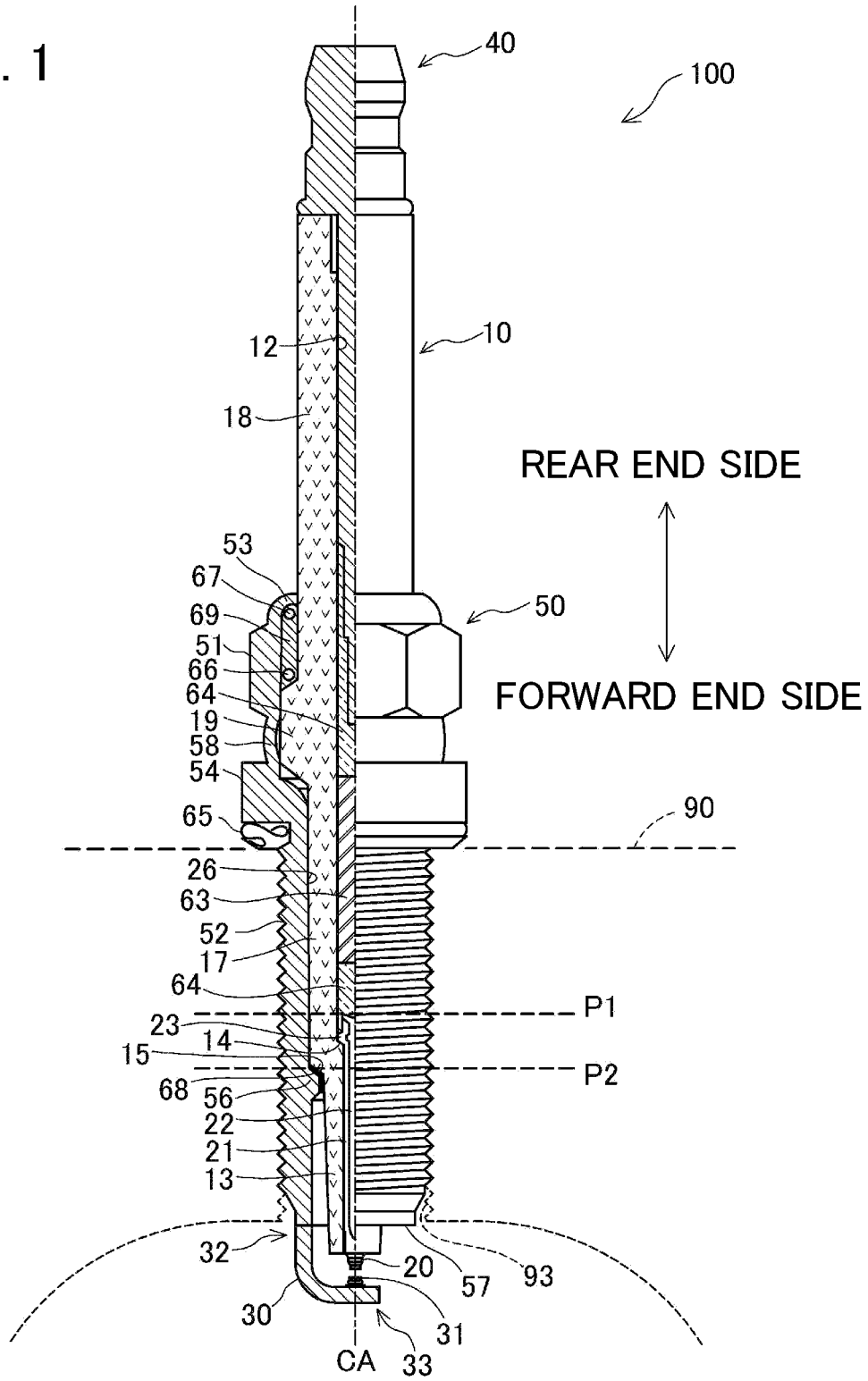
FIG. 1 is an explanatory view showing a partially sectioned spark plug.

FIG. 1 is an explanatory view showing a partially sectioned spark plug 100. In FIG. 1, an external shape of the spark plug 100 is shown on the right side of an axial line CA, which is the center axis of the spark plug 100, and a cross-sectional shape of the spark plug 100 is shown on the left side of the axial line CA. In the description of the present embodiment, the lower side of FIG. 1 will be referred to as the "forward end side" of the spark plug 100, and the upper side of FIG. 1 will be referred to as the "rear end side" of the spark plug 100.

The spark plug 100 includes an insulator 10 having an axial hole 12 extending along the axial line CA, a center electrode 20 disposed in the axial hole 12, a tubular metallic shell 50 disposed around the insulator 10, and a ground electrode 30 whose proximal end 32 is fixed to the metallic shell 50.

The insulator 10 is a ceramic insulator formed by firing a ceramic material such as alumina. The insulator 10 is a member disposed inside the metallic shell 50. Specifically, the insulator 10 is a tubular member having the axial hole 12 at its center. A portion of the center electrode 20 is accommodated in a forward end portion of the axial hole 12, and a portion of a metal terminal 40 is accommodated in a rear end portion of the axial hole 12. A central trunk portion 19 having a large outer diameter is formed on the insulator 10 at the center in the axis direction. A rear trunk portion 18 having an outer diameter smaller than that of the central trunk portion 19 is formed on the rear end side of the central trunk portion 19. A forward trunk portion 17 having an outer diameter smaller than that of the rear trunk portion 18 is formed on the forward end side of the central trunk portion 19. A leg portion 13 whose outer diameter decreases toward the center electrode 20 is formed on the forward end side of the forward trunk portion 17.

The metallic shell 50 is a tubular metal member which surrounds and holds a portion of the insulator 10, from a portion of the rear trunk portion 18 to the leg portion 13. The metallic shell 50 is made of, for example, low-carbon steel, and entirely plated with nickel, zinc or the like. The metallic shell 50 includes a tool engagement portion 51, a seal portion 54, and an attachment screw portion 52, which are disposed in this order from the rear end side. A tool for attaching the spark plug 100 to an engine head 90 is engaged with the tool engagement portion 51. The attachment screw portion 52 is a portion where an external thread is formed over the entire circumference along the outer periphery of the metallic shell 50 and which is screwed into an attachment screw hole 93 of the engine head 90. The seal portion 54 is formed in a flange shape at the proximal end of the attachment screw portion 52. An annular gasket 65 formed by bending a plate is inserted between the seal portion 54 and the engine head 90. The metallic shell 50 has an annular forward-end-side end surface 57 which defines a center opening through which the forward end of the leg portion 13 of the insulator 10 and the forward end of the center electrode 20 project.

A crimp portion 53 having a reduced thickness is provided on the rear end side of the tool engagement portion 51 of the metallic shell 50. A compression deformation portion 58 having a reduced thickness like the crimp portion 53 is provided between the seal portion 54 and the tool engagement portion 51. Annular ring members 66 and 67 are disposed between the outer circumferential surface of the rear trunk portion 18 of the insulator 10 and a portion of the inner circumferential surface of the metallic shell 50, which portion extends from the tool engagement portion 51 to the crimp portion 53. Powder of talc 69 is charged between the two ring members 66 and 67. At the time of manufacture of the spark plug 100, the crimp portion 53 is pressed forward so that the crimp portion 53 is bent inward, and as a result, the compression deformation portion 58 is deformed by compression. As a result of the compressive deformation of the compression deformation portion 58, the insulator 10 is pressed forward in the metallic shell 50 via the ring members 66, 67 and the talc 69. As a result of this pressing, the talc 69 is compressed in the direction of the axial line CA, thereby increasing gastightness in the metallic shell 50.

The metallic shell 50 has a metallic shell internal step portion 56 protruding inward. The position of the rear end of the metallic shell internal step portion 56 in the direction along the axial line CA is denoted by P2. The insulator 10 has an insulator step portion 15 located at the rear end of the leg portion 13 and protruding outward. The metallic shell internal step portion 56 of the metallic shell 50 is in contact with the insulator step portion 15 via an annular sheet packing 68. This sheet packing 68 is a member that maintains gastightness between the metallic shell 50 and the insulator 10, and prevents leakage of combustion gas. In the present embodiment, the packing 68 is a sheet packing.

The center electrode 20 is a rod shaped member composed of an electrode member 21 and a core material 22 embedded in the electrode member 21 and having a thermal conductivity higher than that of the electrode member 21. The electrode member 21 is made of a nickel alloy whose main component is nickel, and the core material 22 is made of copper or an alloy whose main component is copper. A noble metal tip made of, for example, an iridium alloy may be joined to an end portion of the center electrode 20 on the forward end side.

The center electrode 20 has a flange 23 formed near an end portion thereof on the rear end side and bulging outward. The flange 23 comes into contact, from the rear end side, with an axial hole internal step portion 14 protruding inward within the axial hole 12 of the insulator 10, whereby the center electrode 20 is positioned within the insulator 10. On the rear end side of the center electrode 20, the center electrode 20 is electrically connected to the metal terminal 40 via a seal 64 and a ceramic resistor 63. Notably, the position of the rear end of the center electrode 20 in the direction along the axial line CA is denoted by P1.

The ground electrode 30 is made of an alloy whose main component is nickel. The proximal end 32 of the ground electrode 30 is fixed to the end surface 57 of the metallic shell 50. The ground electrode 30 extends from the proximal end 32 along the axial line CA toward the forward end side, and is bent at an intermediate portion such that one side surface of a distal end portion 33 faces the forward end surface of the center electrode 20. A noble metal tip 31 is disposed on the surface of the distal end portion 33 of the ground electrode 30 which faces the center electrode 20. A gap for spark discharge is formed between the noble metal tip 31 and the center electrode 20. The noble metal tip 31 is made of, for example, platinum, iridium, ruthenium, rhodium, or an alloy thereof.

Figure 2:
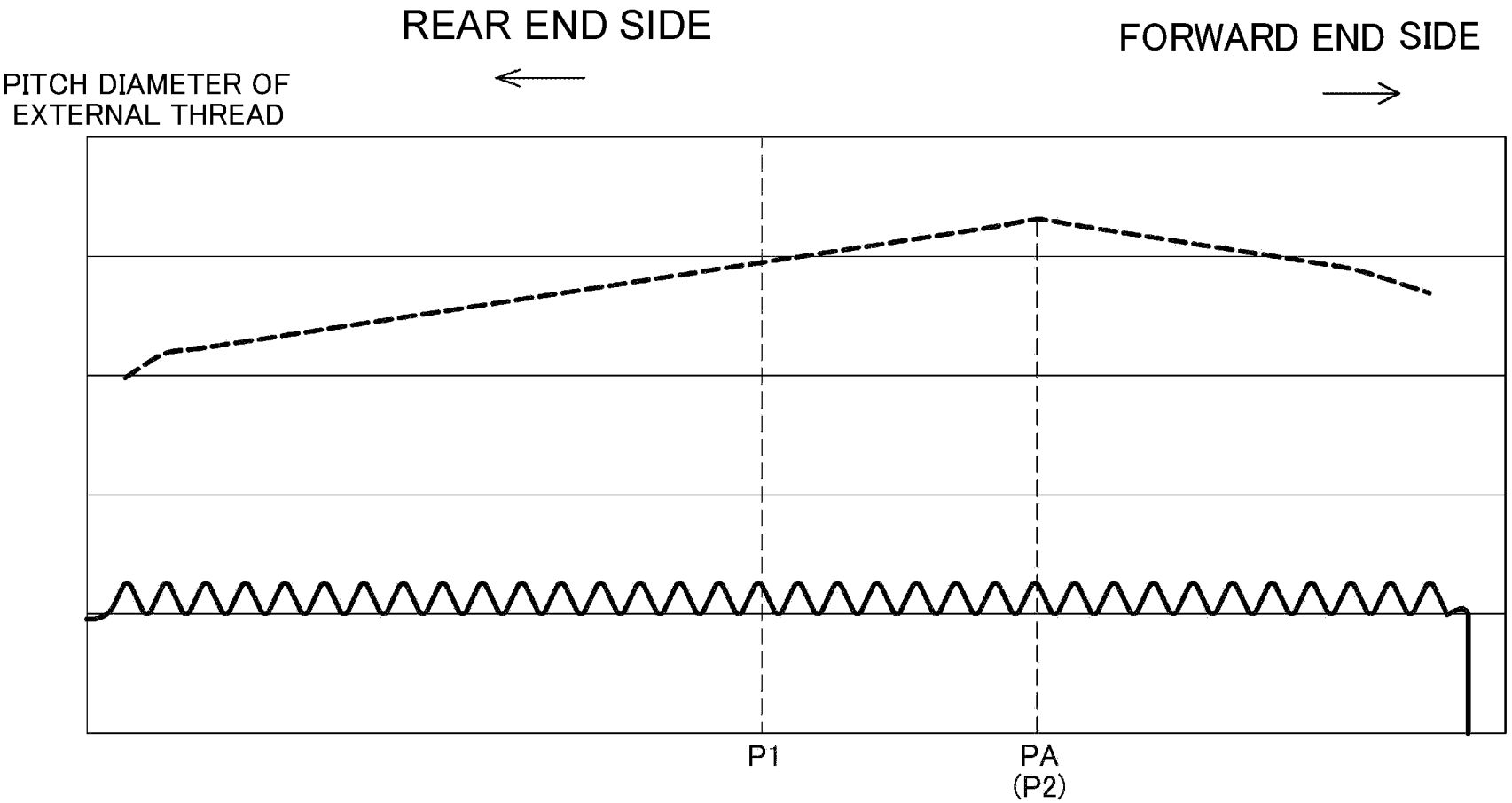
FIG. 2 is a graph showing a change in the pitch diameter of an external thread of an attachment screw portion.

FIG. 2 is a graph showing a change in the pitch diameter of the external thread of the attachment screw portion 52. In FIG. 2, a change in the pitch diameter is shown by a broken line, and the shape of the external thread is shown by a continuous line for reference. In order to facilitate understanding of the contents, the change in the pitch diameter shown by the broken line is rendered greater than the actual change amount, and the change shown by the broken line does not mean the absolute value of the actual change. In FIG. 2, the vertical axis represents the pitch diameter of the external thread, and the horizontal axis represents the position in the direction along the axial line CA. In the present specification, the "pitch diameter of the external thread" shows the value prescribed in JIS B 0205.

As shown in FIG. 2, in the spark plug 100 of the present embodiment, the attachment screw portion 52 has a pitch diameter local maximum portion PA at which the pitch diameter of the external thread becomes the maximum. The "pitch diameter local maximum portion" means a certain portion which is larger in pitch diameter than a portion on the forward end side of the certain portion and a portion on the rear end side of the certain portion. In the present embodiment, the pitch diameter at the pitch diameter local maximum portion PA is 11.100 mm.

Figure 3:
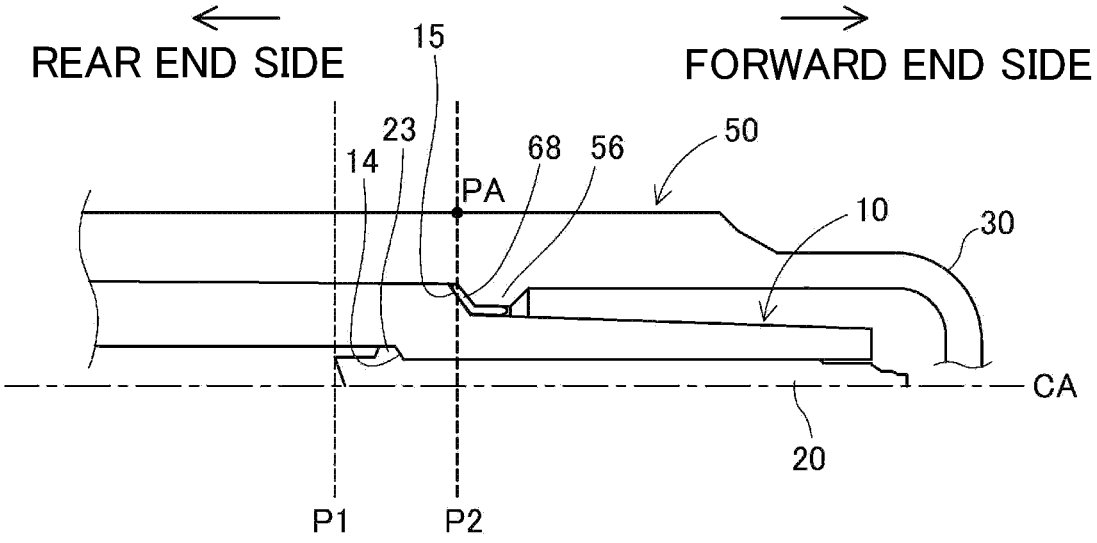
FIG. 3 is a view showing the positional relation of a pitch diameter local maximum portion in the spark plug.

FIG. 3 is a view showing the positional relation of the pitch diameter local maximum portion PA in the spark plug 100. In the present embodiment, the pitch diameter local maximum portion PA is located on the forward end side of the rear end P1 (see also FIG. 1) of the center electrode 20 in the direction along the axial line CA.

The spark plug 100 of the present embodiment is less likely to loosen after having been fixed to the engine head 90. The mechanism for preventing loosening of the spark plug 100 will now be described.

In general, a forward-end-side portion of the spark plug 100 fixed to the engine head 90 receives a larger amount of heat from the interior of the engine as compared with a rear-end-side portion of the spark plug 100. Specifically, whereas the temperature of a forward-end-side portion of the metallic shell 50 of the spark plug 100 increases to about 600° C., the temperature of a rear-end-side portion of the metallic shell 50 increases only to about 100° C. As a result, the forward-end-side portion of the metallic shell 50 thermally expands in a greater amount as compared with the rear-end-side portion of the metallic shell 50.

In the spark plug 100 of the present embodiment, since the pitch diameter local maximum portion PA is located on the forward end side of the rear end P1 of the center electrode 20, the amount of thermal expansion becomes larger as compared with the case where the pitch diameter local maximum portion PA is located on the rear end side of the rear end P1 of the center electrode 20. As a result, upon contact with the engine head 90, the surface pressure increases at the pitch diameter local maximum portion PA. Therefore, wobbling of the spark plug 100 can be prevented, whereby loosening of the spark plug 100 can be prevented.

In the spark plug 100 of the present embodiment, the pitch diameter local maximum portion PA is larger in pitch diameter as compared with a portion on the forward end side of the pitch diameter local maximum portion PA. Therefore, it is possible to prevent damage of the attachment screw hole 93 of the engine head 90, which damage would otherwise occur due to excessive thermal expansion of the portion on the forward end side of the pitch diameter local maximum portion PA.

In the spark plug 100 of the present embodiment, the pitch diameter of the external thread becomes the maximum at the pitch diameter local maximum portion PA. When the metallic shell 50 receives heat from the engine, the heat is conducted to the engine head 90 through the pitch diameter local maximum portion PA in contact with the engine head 90, whereby the heat is released from the metallic shell 50. In the present embodiment, since the pitch diameter local maximum portion PA is located on the forward end side of the rear end P1 of the center electrode 20, the heat is efficiently released from the metallic shell 50 through the pitch diameter local maximum portion PA as compared with the case where the pitch diameter local maximum portion PA is located on the rear end side of the rear end P1 of the center electrode 20. Therefore, the spark plug 100 of the present embodiment is excellent in heat dissipation.

In the spark plug 100 of the present embodiment, the pitch diameter of the external thread becomes the maximum at the pitch diameter local maximum portion PA. When the spark plug 100 of the present embodiment is fixed to the engine head 90, the spark plug 100 comes into contact with the engine head 90 at the pitch diameter local maximum portion PA, so that the surface pressure concentrates at the pitch diameter local maximum portion PA. By virtue of this, loosening of the spark plug 100 can be prevented more effectively as compared with the case where the pitch diameter is uniform.

As shown in FIG. 3, in the present embodiment, the pitch diameter local maximum portion PA is located at the same position as the rear end P2 of the metallic shell internal step portion 56 in the direction along the axial line CA. Namely, in the present embodiment, in the direction along the axial line CA, the pitch diameter local maximum portion PA is located at the position of the metallic shell internal step portion 56. When the insulator 10 and the center electrode 20 receive heat from the interior of the engine, the heat is conducted to the metallic shell 50 through the packing 68 and the metallic shell internal step portion 56, and is conducted to the engine head 90 through the pitch diameter local maximum portion PA. In the present embodiment, since the pitch diameter local maximum portion PA is located at the position of the metallic shell internal step portion 56 in the direction along the axial line CA, the heat is efficiently released from the metallic shell 50 through the pitch diameter local maximum portion PA. Therefore, the spark plug 100 of the present embodiment is excellent in heat dissipation.

In the present embodiment, the length of the attachment screw portion 52 in the direction along the axial line CA is 26.5 mm or more. The "length of the attachment screw portion 52" refers to the length from a forward most portion of the thread to the forward-end-side surface of the seal portion 54. In general, the longer the length of the attachment screw portion 52, the larger the area through which the external thread of the attachment screw portion 52 comes into contact with the internal thread of the engine head 90, and the greater the likeliness of occurrence of loosening. However, the spark plug of the present embodiment can prevent loosening effectively. Notably, the lower limit of the length of the attachment screw portion 52 in the direction along the axial line CA is not limited to 26.5 mm, and the length may be, for example, 18 mm or more. Although no limitation is imposed the upper limit of the length of the attachment screw portion 52 in the direction along the axial line CA, from the viewpoint of easiness of manufacture of the spark plug 100, the length is preferably 70 mm or less, more preferably, 50 mm or less.

B. Second Embodiment

Figure 4:
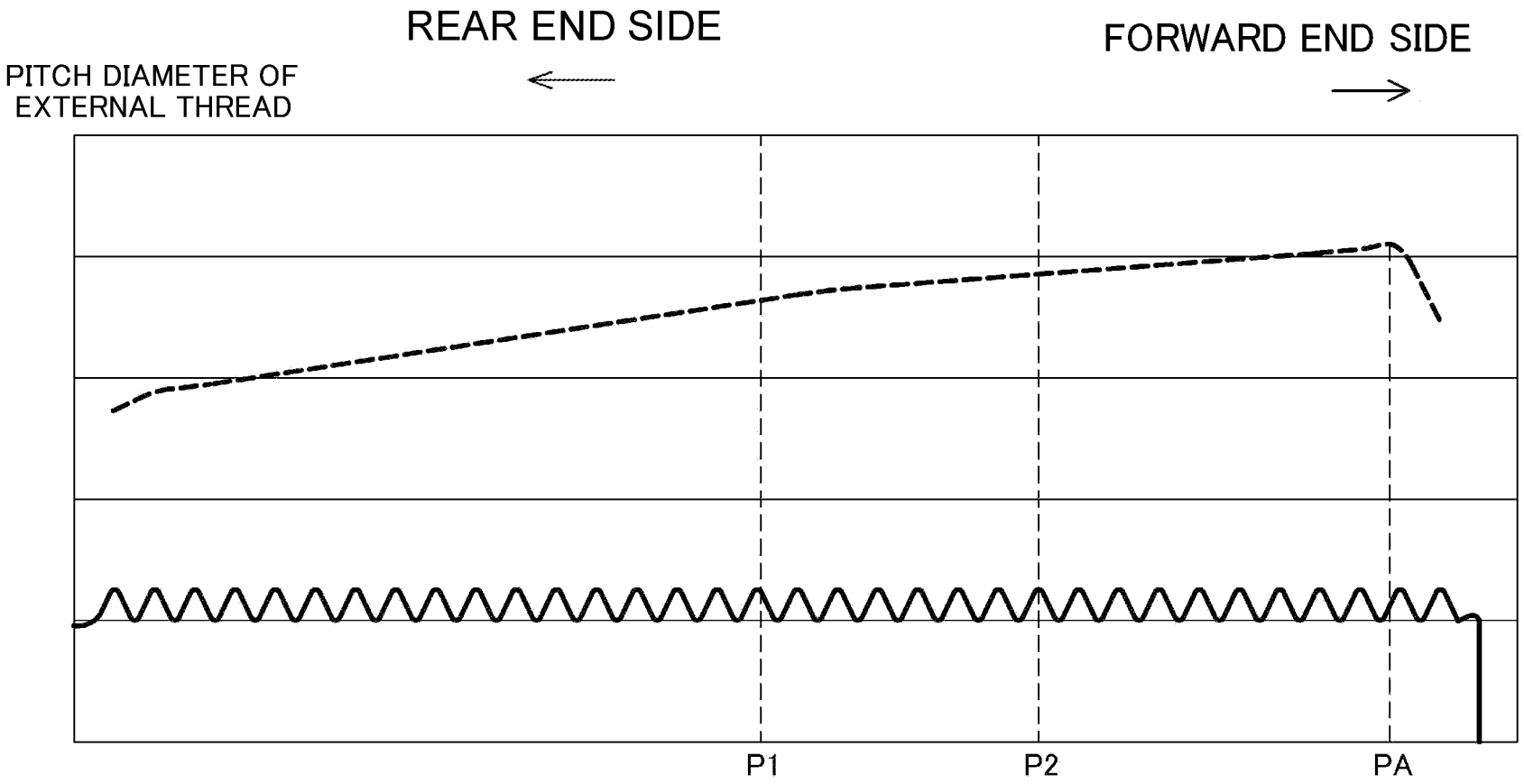
FIG. 4 is a graph showing a change in the pitch diameter of the external thread in a second embodiment.

FIG. 4 is a graph showing a change in the pitch diameter of the external thread in a second embodiment. In FIG. 4 as well, a change in the pitch diameter is shown by a broken line, and the shape of the external thread is shown by a continuous line for reference as in the case of FIG. 2. In order to facilitate understanding of the contents, the change in the pitch diameter shown by the broken line is rendered greater than the actual change amount, and the change shown by the broken line does not mean the absolute value of the actual change. In FIG. 4, the vertical axis represents the pitch diameter of the external thread, and the horizontal axis represents the position in the direction along the axial line CA. The above also applies to FIGS. 5 and 6 which will be referred to later.

The second embodiment is identical in structure with the first embodiment except the manner in which the pitch diameter of the external thread changes. In the second embodiment, the pitch diameter local maximum portion PA is located on the forward end side of the rear end P2 of the metallic shell internal step portion 56. By virtue of this configuration, when the metallic shell 50 receives heat from the engine, the heat is efficiently released from the metallic shell 50 through the pitch diameter local maximum portion PA as compared with the case where the pitch diameter local maximum portion PA is located on the rear end side of the rear end P2 of the metallic shell internal step portion 56.

Therefore, in the present embodiment, the heat dissipation of the metallic shell 50 is enhanced.

C. Third Embodiment

Figure 5:
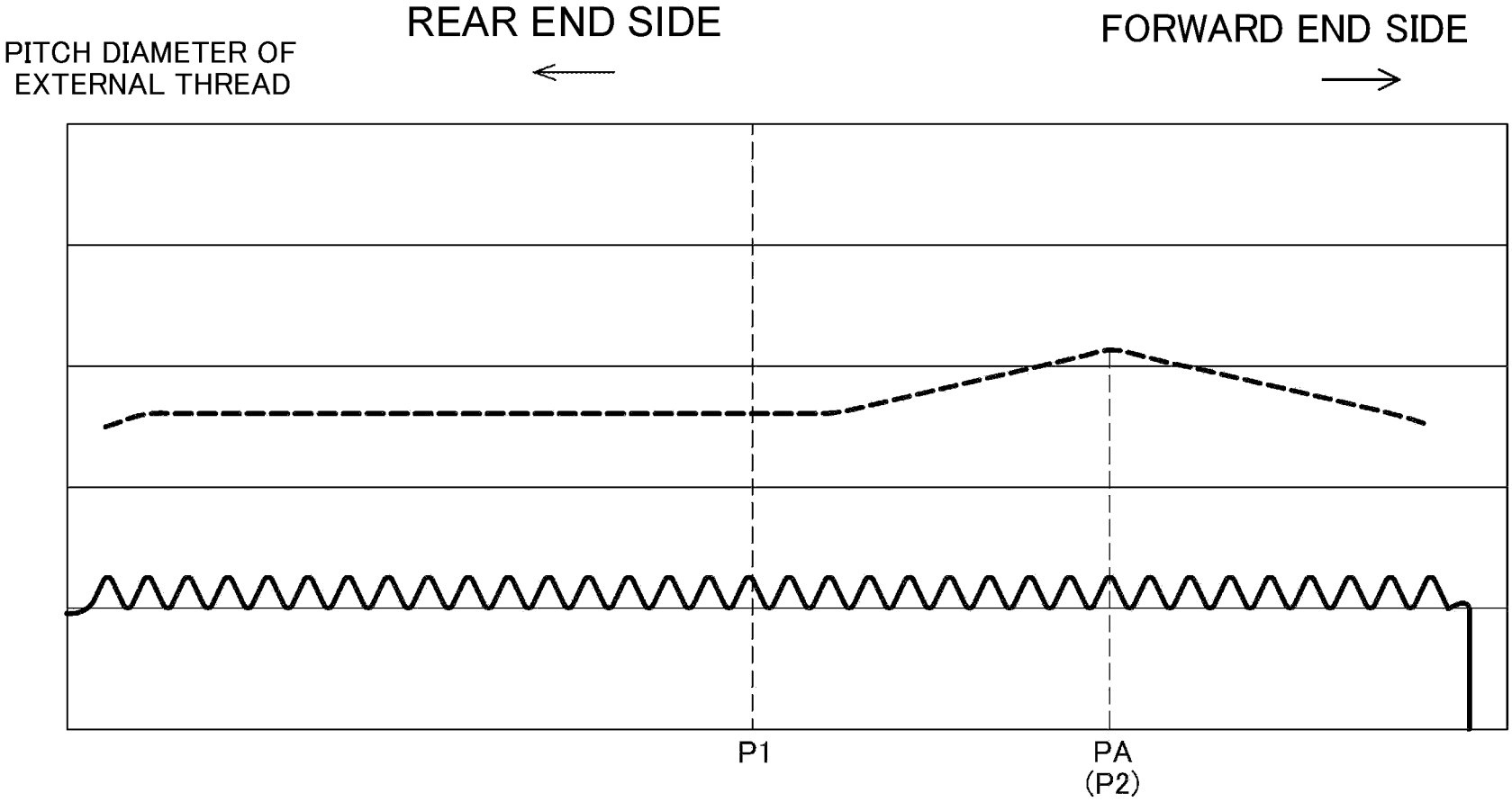
FIG. 5 is a graph showing a change in the pitch diameter of the external thread in a third embodiment.

FIG. 5 is a graph showing a change in the pitch diameter of the external thread in a third embodiment. The third embodiment is identical in structure with the first embodiment except the manner in which the pitch diameter of the external thread changes.

In the third embodiment, the pitch diameter of the external thread is constant on the rear end side of a position near the rear end P1 of the center electrode 20. The pitch diameter of the external thread increases gradually from the position near the rear end P1 of the center electrode 20 until reaching the pitch diameter local maximum portion PA, and decreases gradually from the pitch diameter local maximum portion PA until reaching the forward end. This configuration can also prevent loosening of the spark plug 100.

D. Fourth Embodiment

Figure 6:
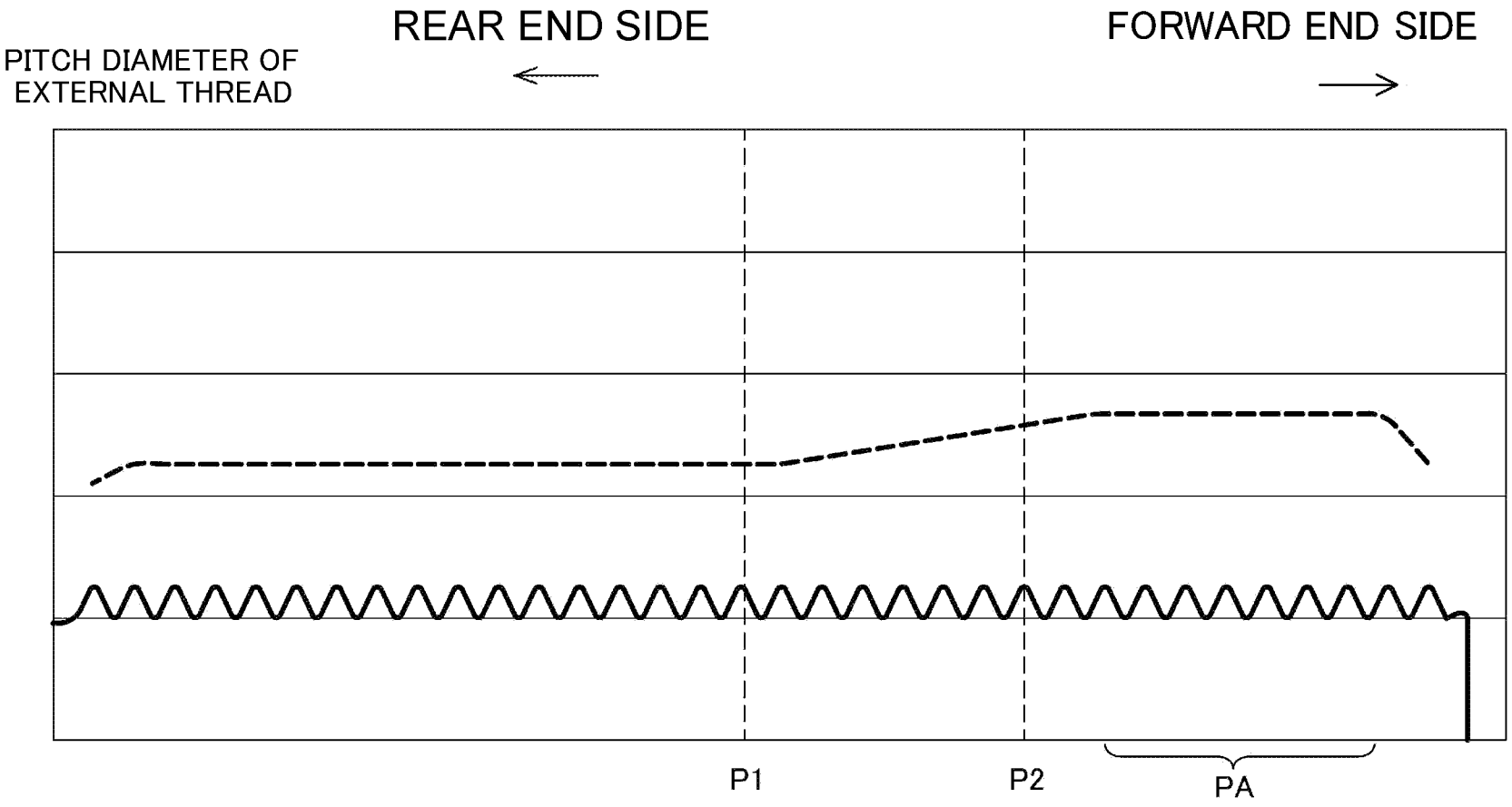
FIG. 6 is a graph showing a change in the pitch diameter of the external thread in a fourth embodiment.

FIG. 6 is a graph showing a change in the pitch diameter of the external thread in a fourth embodiment. The fourth embodiment is identical in structure with the first embodiment except the manner in which the pitch diameter of the external thread changes.

In the fourth embodiment, the pitch diameter of the external thread is constant on the rear end side of a position near the rear end P1 of the center electrode 20. The pitch diameter of the external thread increases gradually from the position near the rear end P1 of the center electrode 20 until reaching a position near the rear end P2 of the metallic shell internal step portion 56, and becomes the maximum at the position near the rear end P2. The external thread has a pitch diameter local maximum portion PA which extends from the position near the rear end P2 and has a predetermined width. This configuration can also prevent loosening of the spark plug 100.

E. Other Embodiments

The present invention is not limited to the above-described embodiments and may be embodied in various other forms without departing from the scope of the invention. For example, the technical features in the embodiments corresponding to the technical features in the modes described in the "SUMMARY" section can be appropriately replaced or combined in order to solve some of or all the foregoing problems or to achieve some of or all the foregoing effects. A technical feature which is not described as an essential feature in the present specification may be appropriately deleted.

In the above-described embodiments, the pitch diameter becomes the maximum at the pitch diameter local maximum portion PA. The position at which the pitch diameter becomes the maximum is not limited to the pitch diameter local maximum portion PA. The pitch diameter may become maximum at a portion other than the pitch diameter local maximum portion PA.

In the above-described embodiments, in the direction along the axial line CA, the pitch diameter local maximum portion PA is located at the same position as the rear end P2 of the metallic shell internal step portion 56 or located on the forward end side of the rear end P2 of the metallic shell internal step portion 56. However, the position of the pitch diameter local maximum portion PA is not limited to these positions. The pitch diameter local maximum portion PA may be located on the rear end side of the rear end P2 of the metallic shell internal step portion 56 in the direction along the axial line CA.

In the above-described embodiments, as shown in FIG. 3, the metallic shell internal step portion 56 protrudes inward in relation to portions located on the forward end side and rear end side, respectively, of the metallic shell internal step portion 56. However, this is not a limitation. It is sufficient that the metallic shell internal step portion 56 protrudes inward in relation to a portion located on the rear end side of the metallic shell internal step portion 56.

In the above-described embodiment, the insulator step portion 15 is located on the forward end side of the axial hole internal step portion 14 in the direction along the axial line CA. However, this is not a limitation. In the direction along the axial line CA, the insulator step portion 15 may be located at the same position as the axial hole internal step portion 14 or located on the rear end side of the axial hole internal step portion 14. Notably, it is preferred from the viewpoint of manufacture of the spark plug 100 that the insulator step portion 15 is located on the forward end side of the axial hole internal step portion 14 in the direction along the axial line CA.

What is claimed is:

1. A spark plug comprising:

a tubular metallic shell having an attachment screw portion having an external thread;

an insulator disposed inside the metallic shell and having an axial hole; and a center electrode disposed in the axial hole, wherein the attachment screw portion has a pitch diameter local maximum portion at which the external thread has a locally maximum pitch diameter, the pitch diameter local maximum portion being located on a forward end side of a rear end of the center electrode in a direction along an axial line of the metallic shell.

2. A spark plug according to claim 1, wherein the pitch diameter of the external thread becomes the maximum at the pitch diameter local maximum portion.

3. A spark plug according to claim 1, wherein the insulator has an insulator step portion protruding outward;

the metallic shell has a metallic shell internal step portion protruding inward;

the insulator step portion is in contact with the metallic shell internal step portion via a packing; and the pitch diameter local maximum portion is located on a forward end side of a rear end of the metallic shell internal step portion in the direction along the axial line.

4. A spark plug according to claim 3, wherein the pitch diameter local maximum portion is located at a position of the metallic shell internal step portion in the direction along the axial line.

5. A spark plug according to claim 1, wherein the attachment screw portion has a length of 26.5 mm or more in the direction along the axial line.

* * * * *